United States Patent [19]

Weiss et al.

[11] Patent Number: 5,039,356

[45] Date of Patent: Aug. 13, 1991

[54] METHOD TO PRODUCE FATIGUE RESISTANT AXISYMMETRIC TITANIUM ALLOY COMPONENTS

[75] Inventors: Isaac Weiss; Daniel Eylon, both of Dayton; Gerhard E. Wesch, Cleveland Heights, all of Ohio; Francis H. Froes, Moscow, Id.

[73] Assignee: The United States of America as Represented by the Secretary of the Air Force, Washington, D.C.

[21] Appl. No.: 571,693

[22] Filed: Aug. 24, 1990

[51] Int. Cl.[5] ..... C22F 1/18

[52] U.S. Cl. ..... 148/11.5 F; 148/12.7 B; 148/133; 148/421; 420/417

[58] Field of Search ..... 148/11.5 F, 12.7 B, 148/133, 421; 420/417

[56] References Cited

U.S. PATENT DOCUMENTS

| | | | |
|---|---|---|---|
| 3,649,374 | 3/1972 | Chalk | 148/11.5 F |
| 3,653,250 | 4/1972 | Collins | 148/11.5 F |
| 3,686,041 | 8/1972 | Lee | 148/11.5 F |
| 3,969,155 | 7/1976 | McKeighen | 148/11.5 F |
| 4,053,330 | 10/1977 | Hendricks et al. | 148/11.5 F |
| 4,543,132 | 9/1985 | Berczik et al. | 148/11.5 F |
| 4,581,077 | 4/1986 | Sakuyama et al. | 148/12.7 B |
| 4,675,055 | 6/1987 | Ouchi et al. | 148/11.5 F |
| 4,854,977 | 8/1989 | Alheritiere et al. | 148/12.7 B |
| 4,871,400 | 10/1989 | Shindo et al. | 148/11.5 F |

*Primary Examiner*—Upendra Roy

*Attorney, Agent, or Firm*—Charles E. Bricker; Donald J. Singer

[57] ABSTRACT

An improved process for producing near-alpha and alpha+beta titanium alloy axisymmetric components with high fatigue resistance which comprises the steps of:

(a) providing a beta processed near-alpha or alpha+-beta titanium alloy component;

(b) torque deforming the component; and (c) alpha+beta recrystallization annealing the resulting torque-deformed component.

11 Claims, 2 Drawing Sheets

METHOD TO PRODUCE FATIGUE RESISTANT AXISYMMETRIC TITANIUM ALLOY COMPONENTS

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of rotating titanium alloy articles to improve the microstructure of such articles.

A wide range of titanium alloys are used in airframe and gas turbine engines for aerospace applications. Considerable research has been directed toward increasing strength and fatigue properties of critical titanium alloy parts, such as airframe and gas turbine compressor components.

Due to the nature of titanium transformation and alloying stabilization behavior, titanium grades can be grouped into three major classes, depending on the phase or phases present in their microstructures. These are alpha/near-alpha, alpha+beta, and near-beta/beta types.

Most titanium alloys currently used for high performance aerospace applications are alpha+beta (e.g., Ti-6Al-4V, a typical airframe alloy) and near-alpha (e.g., Ti-6Al-2Sn-4Zr-2Mo, a typical gas turbine engine compressor alloy) alloys. Commercial emphasis for the manufacture of these alloys has been largely placed on alpha+beta processing to assure adequate strength and ductility. Alpha+beta alloys are the most commonly used titanium alloys and are designed for intermediate strength and high fracture resistance in both airframe and engine applications. Near-alpha alloys possess excellent high temperature properties and are generally designed for high creep properties at high temperatures. Because of lack of toughness in the solution treated and aged condition and relatively poor hardenability, alpha+beta alloys have commonly been used in the annealed condition. As a result, the strength capability of titanium alloys cannot be effectively utilized.

Forging of near-alpha or alpha+beta titanium alloys is one of the most common methods for producing high integrity components for fatigue-critical airframe and gas turbine engine applications. Currently, forging of these classes of alloys is done at temperatures below the beta transus temperature of the alloys because the microstructures developed have a good combination of tensile and fatigue properties. On the other hand, forging near or above the beta transus temperature provides certain advantages in terms of reduced press load and much better shape definition, since the alloy plastic flow resistance is greatly reduced. Unfortunately, the microstructure developed as a result of such forging is a lenticular beta microstructure which is inferior in terms of fatigue performance.

Fatigue failures account for the majority of aircraft in-service component failure. Fatigue failure is divided into crack initiation and crack propagation stages.

In recent years, more and more rotating axisymmetric components are made of titanium alloys. This is due to the relatively low density of titanium which lowers the centrifugal and hoop stresses and subsequently reduces the bearing loads in rotating jet engines. At the same time, high frequency rotation exerts high levels of mechanical vibration, the result of system imbalance or interruption in air or gas flow. This leads to fatigue failure so common in these components.

It is known from titanium metallurgy that fine equiaxed structure, such as that developed during recrystallization treatment, is highly fatigue crack initiation resistant, while beta processed lenticular alpha structure, such as developed during beta extrusion, beta forging or beta anneal, is highly fatigue crack propagation resistant, but inferior in fatigue crack initiation resistance.

By locating fine equiaxed structure in potential crack initiation sites and lenticular beta processed structure in the crack propagation sites, it is possible to obtain components with superior fatigue resistance. It should be noted that in most components, fatigue cracks initiate at or close to the surface and propagate into the bulk of the material. To date, it has been necessary to resort to processing methods such as shot-peening to achieve such partitioned microstructure. Shot-peening of beta processed titanium alloy components has not been successful due to inherent surface cracking, the result of shear band deformation at the surface during the shot peening impact.

What is desired is a method for producing two different microstructural zones in one component or article in a relatively simple manner.

Accordingly, it is an object of the present invention to provide an improved process for producing near-alpha and alpha+beta titanium alloy axisymmetric components with high fatigue resistance.

Other objects, aspects and advantages of the present invention will become apparent to those skilled in the art from a reading of the following detailed description of the invention.

SUMMARY OF THE INVENTION

In accordance with the present invention there is provided an improved process for producing near-alpha and alpha+beta titanium alloy axisymmetric components with high fatigue resistance which comprises the steps of:

(a) providing a beta processed near-alpha or alpha+-beta titanium alloy component;

(b) torque deforming the component; and (c) alpha+beta recrystallization annealing the resulting torque-deformed component.

DETAILED DESCRIPTION OF THE INVENTION

Figure 1:
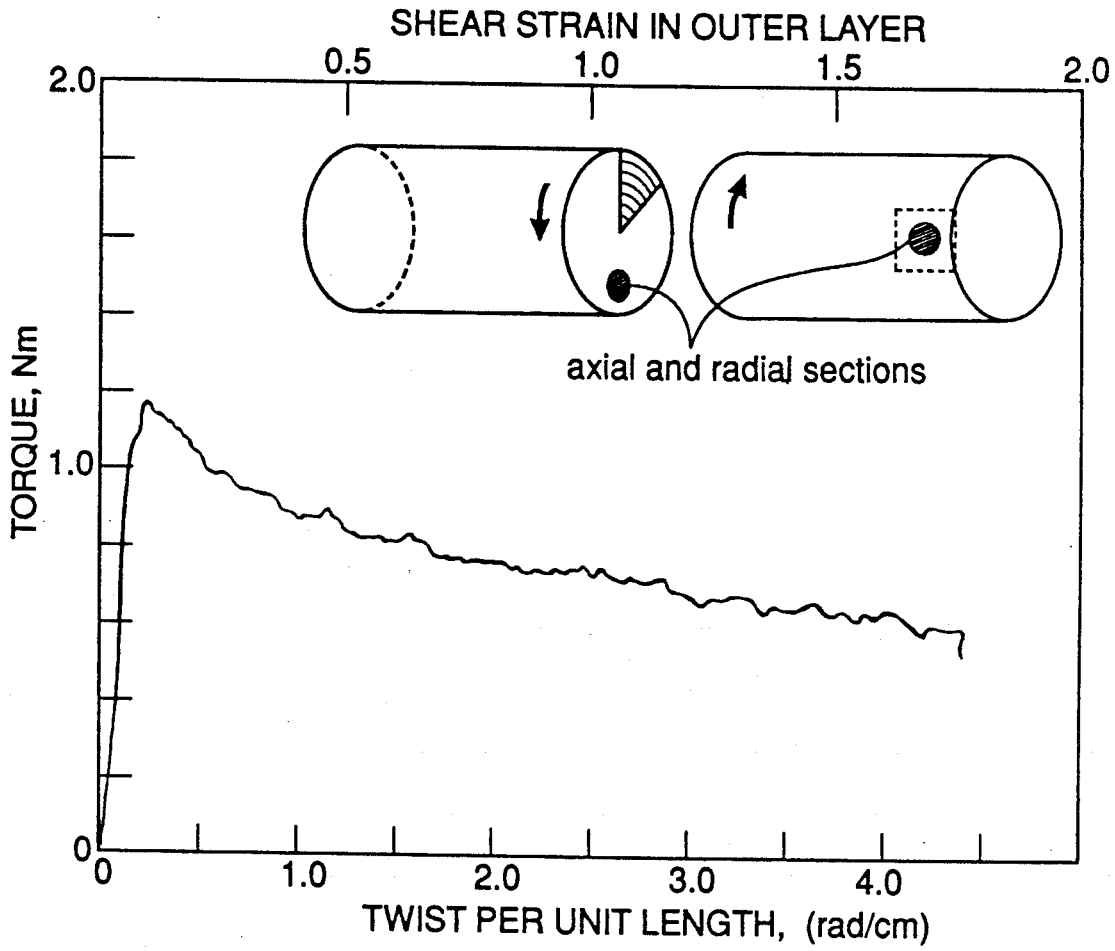
FIG. 1 is a stress-strain diagram for a cylindrical Ti-6Al-2Sn-4Zr-2Mo specimen in torsion. The diagram includes illustrations of axial and radial sections.

The invention was developed with respect to the near-alpha alloy Ti-6Al-2Sn-4Zr-2Mo and will b described with respect to this alloy. The invention is useful for processing the series of titanium alloys known as near-alpha and alpha+beta alloys. Examples of near-alpha titanium alloys include Ti-8Al-1Mo-1V and Ti- 6Al-2Sn-4Zr-2Mo. Examples of alpha+beta titanium alloys include Ti-6Al-4V, Ti-6Al-6V-2Sn, Ti-6Al-2Sn-4Zr-6Mo and Ti-5Al-2Sn-2Zr-4Mo-4Cr.

The titanium alloy component to be processed in accordance with the invention may be extruded, swaged, rolled or forged in the beta phase field, or fabricated in any manner within the beta phase field. An additional annealing at a temperature at which only the beta phase is present is optional, but not necessary and is recommended only if the processing was done too close to the beta transus temperature or below it. Fabrication in such manner provides a component having a lenticular alpha microstructure. Suitable annealing temperatures range from about the beta-transus temperature of the alloy to about 20% above the beta-transus temperature. Following beta-extrusion, -forging or beta-annealing, the component is cooled to a temperature below the beta-transus temperature at a rate which will preserve the lenticular alpha microstructure. Such cooling rate may be as slow as furnace cooling to as fast as water quench.

The beta processed component is then deformed by torsion. The component is first heated to an elevated temperature about 1 to 30 percent below the beta-transus temperature of the alloy, preferably about 2 to 15 percent below the beta-transus temperature of the alloy. A twisting deformation is then applied to the component sufficient to achieve at least about 60% effective strain. Shear strain in torsion is defined as $r\theta/L$, where r is the radius of the component, L is its length and $\theta$ is the torsional angle. The term effective strain is introduced and is defined as shear strain divided by the square root of 3. In general, the twist applied to a component will be in the range of about 1 to 5 radians per centimeter length. The component is then cooled to room temperature at a rate in excess of air cooling.

The component is then annealed in the alpha+beta phase field for about ½ to 8 hours at a temperature about 1 to 20% (in deg-C) below the beta-transus temperature, followed by air cooling to room temperature.

The following example illustrates the invention:

EXAMPLE

A cylindrical specimen of the alpha+beta titanium alloy Ti-6Al-2Sn-4Zr-2Mo (actual composition Ti-5.58Al-1.91Sn-3.0Zr-2.37Mo-0.09Si) having a gauge length of 25.4 mm and a diameter of 7.8 mm was annealed at 1025° C. in the beta phase field and air-cooled to provide a uniform, fine, lamellar microstructure of 1 to 3 μm lamella width. This microstructure is generally considered to be an effective microstructure to resist fatigue crack propagation. The specimen was then heated to 925° C. and torsionally deformed at this temperature at a constant shear strain rate of $0.173s^{-1}$ in the outer layer to above 60% effective strain. At the test temperature of 925° C., this alloy consists of about 74% alpha phase and 26% beta phase. After completion of the deformation, the torsion specimen was rapidly cooled in air to room temperature.

FIG. 1 shows the torque vs. twist for the above specimen. An initial work-hardening period can be seen, up to a shear strain of about 0.08 in the cylinder's surface layer. It is followed by work-softening during the remainder of the test. The work-softening is believed to be a consequence of the break-up of the lamellae. In the microstructure, it manifests itself in regions of localized shear.

Figure 2:
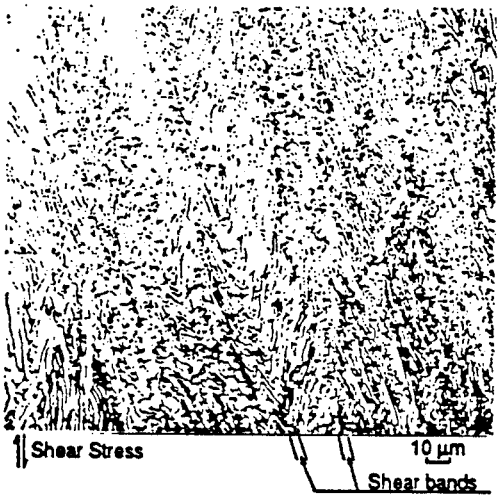
FIGS. 2 and 4 are photomicrographs of a radial cross-section of torqued Ti-6Al-2Sn-4Zr-2Mo alloy.
Figure 3:
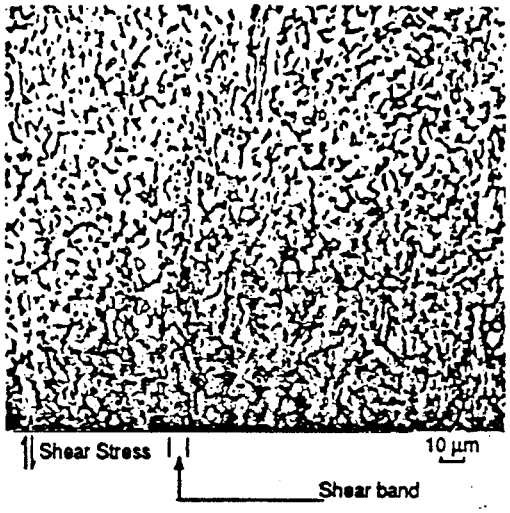
FIG. 3 is a photomicrograph of a radial cross-section of torqued Ti-6Al-2Sn-4Zr-2Mo alloy after recrystallization-anneal.
Figure 4:
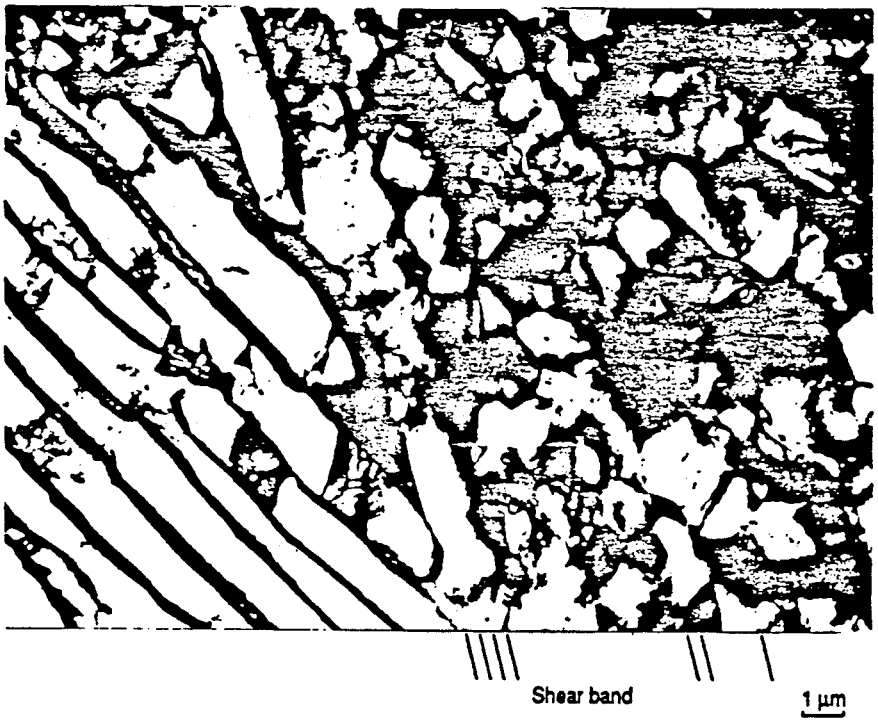

FIG. 1 contains an illustration of axial and radial cross-sections from which representative microstructures were obtained. Referring to FIGS. 2 and 3, the shear bands in the radial cross-section micrographs indicate heterogeneous distribution of shear strain. The bands are approximately parallel to the axial plane which is subjected to the highest shear stress. Deviations from the axial plane are as much as 15° and are most likely due to adjustment of shear bands to crystallographic slip systems in lamella packets. After torsion, the lamellae are either severely bent or have transformed into equiaxed grains by a combination of shear and recrystallization in the areas of severest deformation. The deformed specimen was annealed at 925° C. for one hour. Referring to FIG. 4, it can be seen that such annealing leads to recrystallization-driven spheroidization of the larger size (4 to 8 μm) than the original lamella widths are obtained. This low aspect ratio (more equiaxed) structure at the component surface is more resistant to fatigue crack initiation.

The process of this invention may be used for fabricating fatigue-rated titanium alloy rotating components, such as components of the entire compressor section and the low pressure section of the turbine in gas turbine engines. The process may also be used to fabricate gyroscope components and torque bars.

Various modifications may be made to the invention as described without departing from the spirit of the invention or the scope of the appended claims.

We claim:

1. An improved process for producing near-alpha and alpha+beta titanium alloy axisymmetric components with high fatigue resistance which comprises the steps of:

(a) providing a beta processed near-alpha or alpha+beta titanium alloy component;

(b) torque deforming said component; and (c) alpha+beta annealing the resulting torque-deformed component.

2. The process of claim 1 wherein said providing step (a) consists of beta annealing said component.

3. The process of claim 1 wherein said providing step (a) consists of beta extruding said component.

4. The process of claim 1 wherein said providing step (a) consists of beta forging said component.

5. The process of claim 1 wherein said torque deforming step (b) consists essentially of:

(i) heating said component to an elevated temperature;

(ii) applying twisting deformation to said component; and (iii) cooling said component.

6. The process of claim 1 wherein said annealing step (c) consists of heating the deformed component from step (b) at a temperature about 1 to 20% below the beta-transus temperature for about ½ to 8 hours, and air cooling the thus-heated component.

7. The process of claim 1 wherein said titanium alloy is Ti-6Al-2Sn-4Zr-2Mo.

8. The process of claim 5 wherein said heating step (i) consists of heating said component to a temperature about 1 to 30 percent below the beta-transus temperature of said alloy.

9. The process of claim 5 wherein said heating step (i) consists of heating said component to a temperature about 2 to 15 percent below the beta-transus temperature of said alloy.

10. The process of claim 5 wherein said twisting step (ii) consists of applying twisting deformation sufficient to achieve at least about 60% effective strain.

11. The process of claim 10 wherein the twist applied is about 1 to 5 radians per centimeter length.

* * * * *